US006446805B1

(12) United States Patent
Mann et al.

(10) Patent No.: US 6,446,805 B1
(45) Date of Patent: Sep. 10, 2002

(54) CONTAINER FOR PLANTS

(75) Inventors: Michele Mann, 8157 McCauly Ct., Cincinnati, OH (US) 45241; Steven I. Imes, Brookville, OH (US)

(73) Assignee: Michele Mann, Cincinnati, OH (US)

( * ) Notice: Subject to any disclaimer, the term of this patent is extended or adjusted under 35 U.S.C. 154(b) by 0 days.

(21) Appl. No.: 09/862,812

(22) Filed: May 22, 2001

Related U.S. Application Data

(60) Provisional application No. 60/207,163, filed on May 26, 2000.

(51) Int. Cl.[7] ..... B65D 85/52
(52) U.S. Cl. ..... 206/423; 206/486
(58) Field of Search ..... 206/423, 486, 206/102, 170, 175, 176, 177; 47/20, 21, 40.5, 44, 47; 229/87.04

(56) References Cited

U.S. PATENT DOCUMENTS

| | | | | | |
|---|---|---|---|---|---|
| 2,774,187 | A | * | 12/1956 | Smithers | 206/423 |
| 4,113,093 | A | * | 9/1978 | Hendrickx | 206/423 |
| 4,184,595 | A | * | 1/1980 | Wackerman | 206/423 |
| 4,941,572 | A | * | 7/1990 | Harris | 206/423 |
| 5,029,708 | A | * | 7/1991 | Alonso et al. | 206/423 |

* cited by examiner

*Primary Examiner*—Luan K. Bui
(74) *Attorney, Agent, or Firm*—Alfred J. Mangels

(57) ABSTRACT

A container for plants in which an outer container includes an inner carrier that carries a plant. The inner carrier supports a pot or a wrapped root ball and is slidably inserted within the outer container. The outer container encloses and protects the inner carrier and the plant during shipment, and it includes an integral carrying handle to allow the container to be conveniently carried.

11 Claims, 3 Drawing Sheets

CONTAINER FOR PLANTS

CROSS-REFERENCE TO RELATED APPLICATION

This application claims the benefit of U.S. Provisional Application No. 60/207,163, filed on May 26, 2000.

BACKGROUND OF THE INVENTION

1. Field of the Invention

The present invention relates to carrying containers for carrying and shipping plant material, such as small trees, small bushes, and the like. More particularly, the present invention relates to a carrying and shipping container for plant material in which an outer container slidably receives an inner carrier that supports the plant material within the outer container.

2. Description of the Relation Art

Small trees, of the order of about two to three feet in height, small bushes, and the like, are normally provided with the root system in a plastic pot, or the like, or the root system is wrapped in burlap or in some other material to retain earth around the roots. Typically, the plants are not enclosed within a container, but are simply transported and carried by grasping the pot or the wrapped root system.

At times, people wish to give gifts to others of small trees that can serve as a memento or as a remembrance. Accordingly, it is desirable to provide a carrying and shipping container whereby such plant gifts can be easily transported and shipped, and without injury to the plant.

It is an object of the present invention to overcome the deficiencies of the prior art approach and to provide a convenient and safe arrangement for carrying and shipping plant materials.

SUMMARY OF THE INVENTION

Briefly stated, in accordance with one aspect of the present invention, a container for plants is provided in which an outer container defines an enclosure and includes a carrying handle. An inner carrier is positioned within the outer container for supporting plant material, the plant material including a root system, a trunk or primary stalk, and a leafy crown. The inner carrier is non-rotatably but slidably received within the outer container and includes a root system enclosure and an opening in the root system enclosure to allow the primary stalk of the plant to extend therethrough.

DESCRIPTION OF THE PREFERRED EMBODIMENTS

Figure 1:
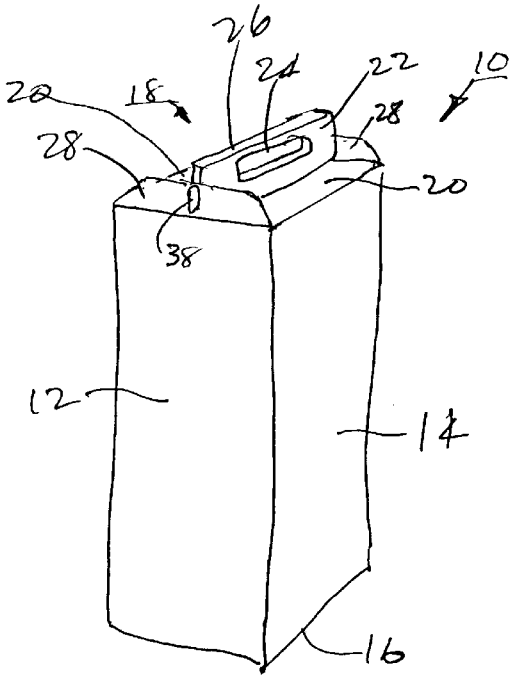
FIG. 1 is a perspective view of a container for plants in accordance with the present invention and showing an outer container in assembled form.

Referring now to the drawings, and particularly to FIG. 1 thereof, there is shown an assembled outer container 10 in accordance with the present invention for transporting and carrying a plant, such as a small tree having a height of from about two to about three feet. Outer container 10 includes a pair of opposed, rectangular side panels 12 (only one of which is visible in FIG. 1), a pair of opposed, rectangular face panels 14 (only one of which is visible in FIG. 1), a base 16, and a top 18. Top 18 is defined by a pair of end panels 20, each including a pair of side-by-side handle flaps 22 that each have an opening 24 to provide a carrying handle. Handle flaps 22 are received in and are retained by a pair of opposed handle retainer flaps 28.

Figure 3:
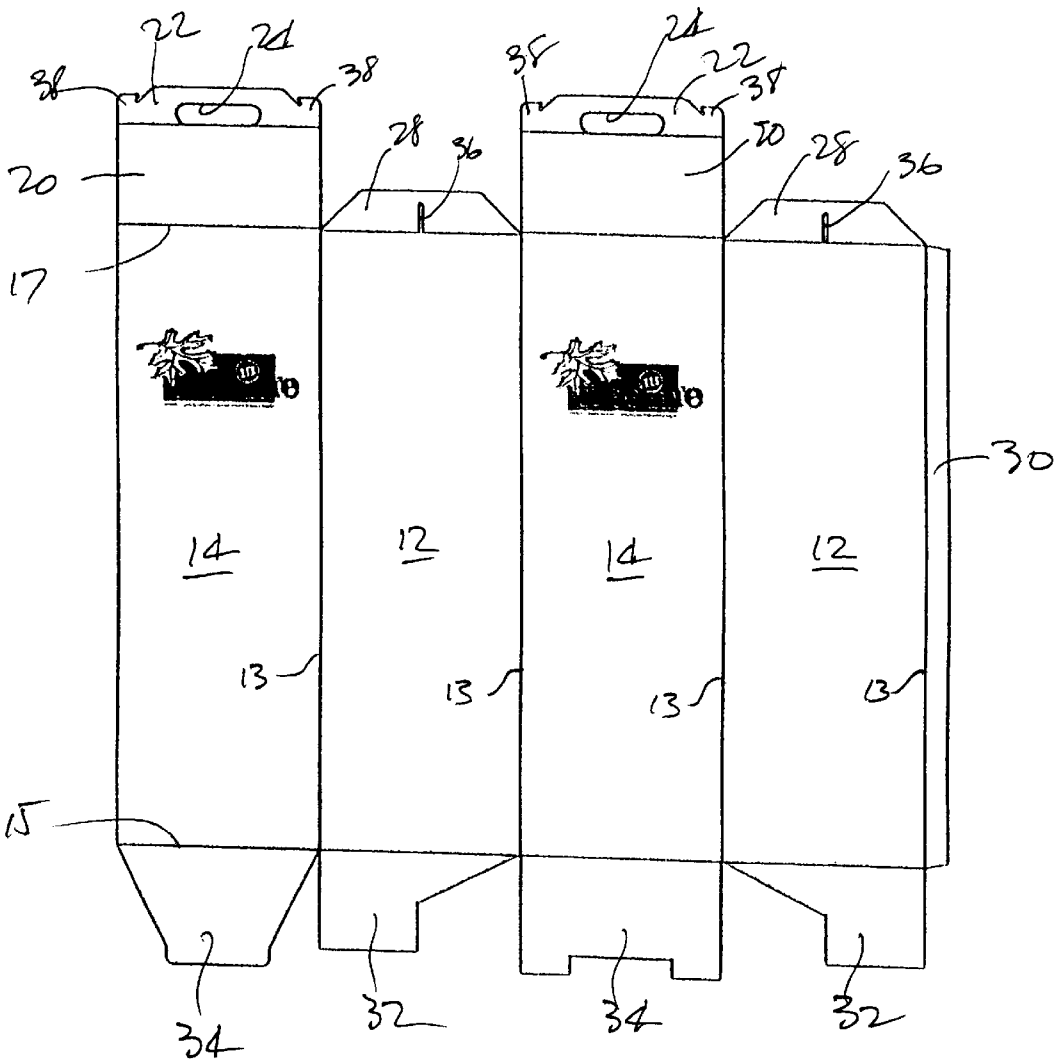
FIG. 3 is a container blank for the outer container forming part of the present invention.

The arrangement of the several panels of outer container 10 are shown in FIG. 3, in which a blank 11 from which outer container 10 is formed is shown in its flat state before assembly into a container. As shown, side panels 12 and face panels 14 are rectangular and alternate with each other. Side panels 12 and face panels 14 are separated by parallel, longitudinally-extending score lines 13. One of the outermost longitudinal edges of one of side panels 12 includes a narrow, outwardly extending joinder flap 30 to provide a manufacturer's joint when flap 30 is adhesively joined along a longitudinal edge of the inner face of the endmost face panel 14 to provide a tubular outer container having a rectangular cross section, as will be appreciated by those skilled in the art. Base 16 of outer container 10 includes a pair of inner end flaps 32 connected with one end of each of side panels 12 by laterally-extending score line 15, and a pair of outer end flaps 34 connected with one end of each of face panels 14 by score line 15.

Blank 11 for outer container 10 includes a pair of top end panels 20 that are hingedly connected with and that extend from respective ends of face panels 14 along laterally-extending score line 17. Each of end panels 20 includes a laterally-extending handle flap 22 that has an elongated opening 24 to permit container 10 to be easily carried. Extending from one edge of each of side panels 12 and hingedly connected thereto by score line 17 is a handle retainer flap 28 that includes a narrow, longitudinally-extending slot 36. As shown in FIG. 3, each of handle flaps 22 includes a pair of laterally-spaced end tabs 38 that are receivable within and are engageable with respective slots 36 formed in retainer flaps 28 to provide a closed, upper container end of the form shown in FIG. 1. Base 16 of outer container 10 is defined by overlapping and interconnecting end flaps 32 and 34.

Figure 2:
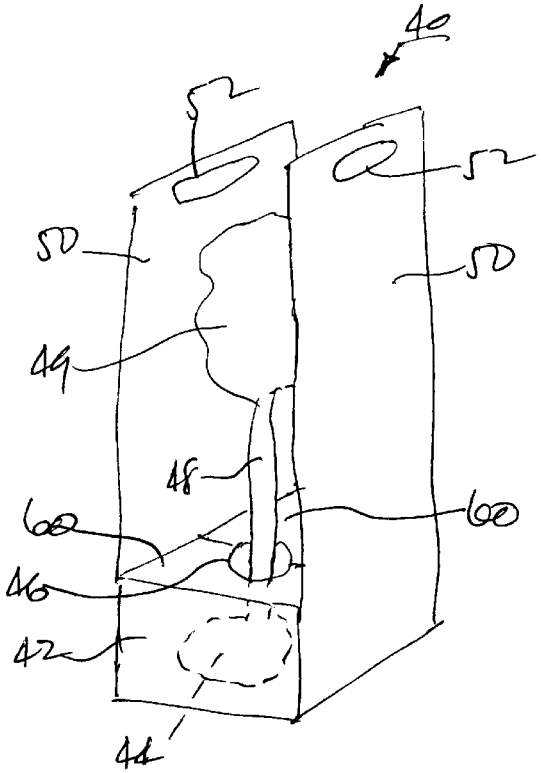
FIG. 2 is a perspective view of an inner carrier in accordance with the present invention, which is adapted to carry plant material and to fit within the outer container shown in FIG. 1.
Figure 4:
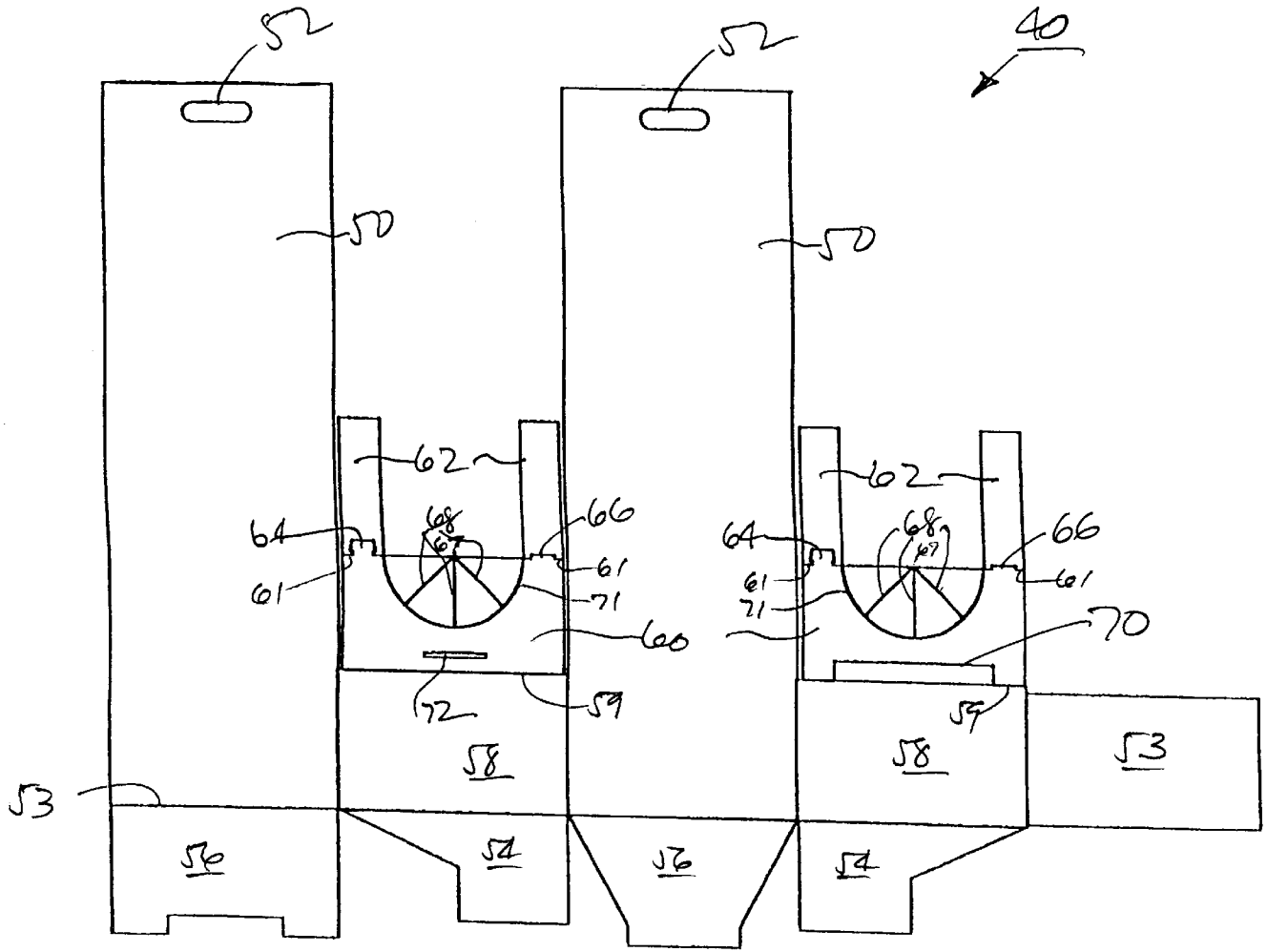
FIG. 4 is a blank for the inner carrier forming part of the present invention.

Outer container 10 receives and encloses an inner carrier 40 that is shown in assembled form in FIG. 2 and is shown in the form of a flat blank in FIG. 4. As shown in FIG. 2, inner carrier 40 includes a plant root system enclosure 42 to enclose the root system 44 of a plant and that has an opening 46 to allow trunk 48, or the primary stalk or main branches of a plant, to extend therethrough. A pair of opposed, elongated, rectangular carrier panels 50 extend upwardly from root system enclosure 42 and preferably include respective hand openings 52 to facilitate insertion into and removal from outer container 10 of inner carrier 40. The longitudinal lengths of carrier panels 50 are preferably substantially the same longitudinal length as that of side panels 12 and face panels 14 of outer container 10, so that the upper and lower ends of carrier panels 50 contact top 18, and base 16, respectively, of outer container 10 to prevent longitudinal sliding movement of inner carrier 40 relative to outer container 10 when the outer container is in its closed condition as shown in FIG. 1.

As best seen in FIG. 4, inner carrier 40 also includes four end flaps for forming a bottom wall of enclosure 42. The bottom wall is defined by inner end flaps 54 and outer end flaps 56, provided in a form similar to end flaps 32 and 34 of outer container 10, to interengage with each other and to provide with base 16 of outer container 10 a multiple-thickness bottom support wall for supporting the weight of the plant and root system when the plant is positioned within container 10 for carrying. Inner end flaps 54 and outer end flaps 56 are hingedly connected with inner carrier 40 along score line 53.

Inner carrier 40 includes a pair of side panels 58 that alternate with and have a shorter longitudinal length than do carrier panels 50. Side panels 58 and carrier panels 50 are hingedly connected by respective longitudinally-extending score lines 51. An optional end panel 55 can be hingedly connected with endmost side panel 58. Carrier panels 50 and side panels 58, as well as end panel 55 when present, together with the adjacent end portions of carrier panels 50 define the longitudinally-extending walls of root system enclosure 42.

Hingedly connected with each of side panels 58 by score lines 59 is a generally rectangular retainer panel 60. Each retainer panel 60 includes a pair of parallel, rectangular extensions 62 that define vertical support legs for maintaining retainer panels 60 in substantially coplanar relationship when inner carrier 40 is in assembled form. Extensions 62 are hingedly connected with retainer panels 60 by means of score lines 61. One portion of score line 61 at one extension 62 extending from each of retainer panels 60 includes a cut section that defines a connecting tab 64, while at another portion of score line 61 the remaining extensions 62 that extend from retainer panels 60 each include a connection slot 66 to receive the connecting tab 64 of the opposite extension 62.

A series of radially-extending cuts 68 through retainer panel 60 that radiate from a common point 67 are provided in each of retainer panels 60 to allow downward deflection of the respective sectors 69 that are thereby formed. Score lines 71 extend between and interconnect the radial ends of cuts 68 to define opening 46 (see FIG. 2) that serves to provide a supporting ring for a pot or a root ball when inner carrier 40 is assembled. One of retainer panels 60 can include a rectangular slot 70 that defines a rectangular opening to receive and retain a plaque, as will be hereinafter described. The other retainer panel 60 can include a narrow slot 72 to receive a plaque holder, as will be hereinafter described.

Outer container 10 is assembled in a well-known manner by pivoting side panels 12 and face panels 14 relative to each other and by adhesively securing joinder flap 30 with the inner surface of outermost face panel 14 to define a tubular enclosure. Base 16 is formed by interconnecting the several end flaps 32 and 34 to define the outer container bottom wall or base 16.

Inner carrier 40 is formed into a tubular structure of the type shown in FIG. 2 by pivoting the respective carrier panels 50 and side panels 58 relative to each other along score lines 51. Retainer panels 60 are each pivoted toward each other, inwardly relative to side panels 58, with the respective extensions 62 further pivoted inwardly relative to retainer panels 60 to a position substantially perpendicular to retainer panels 60 so that their outermost ends contact the end wall defined by end flaps 54, 56. Extensions 62 provide vertical support to retainer panels 60 to maintain them in a substantially coplanar or horizontal position, parallel with the base of inner carrier 40 as defined by folded-over end flaps 54 and 56 when inner carrier 40 is in assembled form.

The respective sectors defined by cut lines 68 can then be pivoted inwardly about score lines 71, to provide opening 46 to receive a pot, or to allow a wrapped root system to be positioned within root system enclosure 42 defined by side panels 58 of inner carrier 40. As shown in FIG. 2, trunk 48 of the plant extends through opening 46 and leafy crown 49 is to be positioned between opposed carrier panels 50. Inner carrier 40 is then slidingly inserted into outer container 10 through the open top end thereof by grasping the inner carrier by the hand openings 52 formed in respective carrier panels 50 and lowering inner carrier 40, with the plant within it, into outer container 10. The vertical height of respective carrier panels 50 is slightly less than the longitudinal length of side and face panels 12, 14 of outer container 10, so that end panels 20 of outer container 10 can be folded inwardly to form a top wall and to close the container. As will be appreciated, hand openings 52 also facilitate removal of inner carrier 40 when it is desired to remove the plant from outer container 10.

Figure 5:
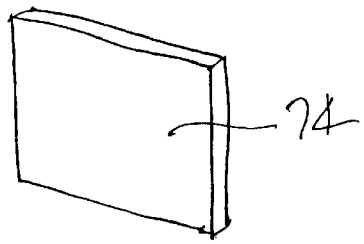
FIG. 5 is a perspective view of a display plaque that can be carried within the outer container along with the plant material.

A plate-like plaque, such as a thin, rectangular plaque 74 shown in FIG. 5, can be provided to accompany the plant and can be inscribed with a suitable message, such as the name of the recipient of the plant, the date of the gift, the occasion for which the gift is given, and the like. When it is provided, plaque 74 can be carried within plaque slot 70 defined in one of retainer panels 60 of inner carrier 40 to hold plaque 74 during shipment of the plant.

Figure 6:
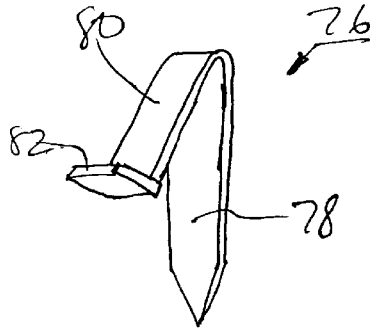
FIG. 6 is a perspective view of a display plaque support that can be carried within the outer container.

Additionally, when a plaque 74 is provided, a plaque support 76 can also be provided. Plaque support 76 is shown in FIG. 6 and includes a stake portion 78 to penetrate the ground adjacent to the plant when it is planted, a plaque back support panel 80 against which the plaque can rest, and a plaque shelf 82, against which a peripheral edge of plaque 74 can rest to provide support for an edge of the plaque. Plaque back support panel 80 can be disposed at an angle relative to stake portion 78, and that angle can be any convenient angle, between about 10° and about 75°. Plaque support 76 can also be carried within inner carrier 40 during shipment of the plant, by sliding stake portion 78 into slot 72 that is formed in the other retainer panel 60 forming part of inner carrier 40.

As can be seen, the present invention provides a convenient container for carrying and shipping a plant, without damage, and also for enclosing and holding a plaque and a plaque support when the plant is intended as a gift or is to include an identifying element when the plant is permanently planted.

Although particular embodiments of the present invention have been illustrated and described, it will be apparent to those skilled in the art that various changes and modifications can be made without departing from the spirit of the present invention. Accordingly, it is intended to encompass within the appended claim all such changes and modifications that fall within the scope of the present invention.

What is claimed is:

1. A container for plants, said container comprising:

a. an outer container including a carrying handle; and b. an inner carrier positioned within the outer container for receiving and supporting a plant, the plant including a root system, a trunk, and a leafy crown, wherein the inner carrier is non-rotatably and slidably received within the outer container and includes a root system enclosure having an opening to allow the trunk of the plant to extend through the opening and a pair of opposed carrier panels that extend from the root system enclosure, and wherein the carrier panels include hand openings spaced from the root system enclosure for slidably separating the inner carrier from the outer container.

2. A container in accordance with claim 1, wherein the root system enclosure includes a bottom wall, a pair of opposed side walls extending from the bottom wall, a pair of opposed end walls extending from the bottom wall and alternating with the side walls, and a top wall formed by a pair of retainer panels that include opposed open areas defining the opening.

3. A container in accordance with claim 2, wherein the retainer panels each include at least one extension panel having a length substantially equal to a longitudinal dimension of a side panel for minimizing deflection of the retainer panels relative to and toward the inner carrier bottom wall.

4. A container in accordance with claim 2, wherein one retainer panel includes a connecting tab and the other retainer panel includes a connection slot for receiving the connecting tab to interconnect the retaining panels in substantially coplanar relationship.

5. A container in accordance with claim 3, wherein at least on retainer panel includes a rectangular opening for receiving and retaining an element having a substantially rectangular cross section.

6. A container in accordance with claim 5, wherein the element is a rectangular plaque.

7. A container in accordance with claim 5, wherein the element is a stake.

8. A container in accordance with claim 1, wherein the outer container surrounds and encloses the inner carrier to prevent relative movement between the outer container and the inner carrier when the outer container is in closed condition.

9. A container in accordance with claim 1, wherein the inner carrier has a longitudinal dimension that corresponds with that of the outer container to prevent relative sliding movement of the inner carrier relative to the outer container when the outer container is in closed condition.

10. A container in accordance with claim 1, wherein the outer container includes a pair of opposed handle retainer flaps each having a slot for receiving at least one handle flap carried by the carrying handle.

11. A container in accordance with claim 10, wherein the at least one handle flap includes a pair of spaced end tabs that are received in the respective retainer flap slots.

* * * * *